US006203848B1

(12) United States Patent
Cho et al.

(10) Patent No.: US 6,203,848 B1
(45) **Date of Patent: *Mar. 20, 2001**

(54) METHOD FOR INCREASING THE CHARRING RATIO OF COAL

(75) Inventors: Min Young Cho; Myoung Kyun Shin; Young Che Chung, all of Pohang; Dael Whei Lee, Dalsung-kun, all of (KR)

(73) Assignees: Pohang Iron & Steel Co., Ltd.; Research Institute of Industrial Science & Technology, both of (KR); Voest-Alpine Industrieanlagenbau GmbH (AT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/125,453

(22) PCT Filed: Dec. 19, 1997

(86) PCT No.: PCT/KR97/00272

§ 371 Date: Aug. 19, 1998

§ 102(e) Date: Aug. 19, 1998

(87) PCT Pub. No.: WO98/28385

PCT Pub. Date: Jul. 2, 1998

(30) Foreign Application Priority Data

Dec. 20, 1996 (KR) ..... 96-68766
Dec. 27, 1996 (KR) ..... 96-73769

(51) Int. Cl.[7] ..... B05D 7/00

(52) U.S. Cl. ..... 427/215; 427/213; 427/217

(58) Field of Search ..... 427/213, 215, 427/217; 44/543, 602, 603, 620

(56) References Cited

U.S. PATENT DOCUMENTS

| | | | | |
|---|---|---|---|---|
| 1,555,590 | * | 9/1925 | Lahart | 44/4 |
| 1,856,495 | * | 5/1932 | McGlone | 44/4 |
| 2,247,415 | * | 7/1941 | Stillman | 44/4 |
| 3,004,836 | * | 10/1961 | Thompson | 44/4 |
| 4,244,699 | * | 1/1981 | Smith et al. | 44/1 |
| 4,280,817 | * | 7/1981 | Chauhan et al. | 44/1 |
| 4,410,350 | * | 10/1983 | Judd | 427/212 |
| 5,281,445 | * | 1/1994 | Khare | 427/219 |
| 5,350,596 | * | 9/1994 | Walker, Jr. | 427/215 |
| 5,441,566 | * | 8/1995 | Vaughan | 427/212 |

FOREIGN PATENT DOCUMENTS

| | | |
|---|---|---|
| 88102 | 7/1988 | (AU) . |
| 4 036 448 | 5/1991 | (DE) . |
| 0210333 | 4/1986 | (EP) . |
| WO 96/19410 | 6/1996 | (WO) . |

OTHER PUBLICATIONS

Scaroni, Alan W., et al., "Effect of surfaces on the yield of volatiles from coal", FUEL, 1981, vol. 60, Jun. pp. 558–559.

* cited by examiner

*Primary Examiner*—Shrive Beck
*Assistant Examiner*—Paul D. Strain
(74) *Attorney, Agent, or Firm*—Webb Ziesenheim Logsdon Orkin & Hanson, P.C.

(57) ABSTRACT

Disclosed is a method for increasing the charring ratio of coal. In manufacturing an ingot iron using the coal, magnesium oxide or limestone is used as an additive for charring the coal. The additive increases the charring ratio of the coal while giving no affection onto slag. An MgO suspension or limestone suspension is mixed with the coal and thus obtained mixture is dried to attach MgO or the limestone onto the surface of the coal. The charring effect is increased and the using amount of coke can be reduced.

2 Claims, 3 Drawing Sheets

METHOD FOR INCREASING THE CHARRING RATIO OF COAL

BACKGROUND OF THE INVENTION

1. Field of the Invention

The present invention relates to a method for increasing the charring ratio of coal, and more particularly, to a method for increasing the charring ratio of coal in the coal based ironmaking process using the coal.

2. Description of the Prior Art

Generally, the manufacturing apparatus of an ingot iron utilizing the known COREX process which is a smelting reduction process, suitable as a blast furnace substituting ironmaking process, can be largely classified into a melter-gasifier and a reduction shaft furnace. Ore passes through the reduction shaft furnace and then is fed into the melter-gasifier to produce the molten iron. The coal is fed into the melter-gasifier to play the role of iron ore reducing agent and fuel for melting the iron ore. When the coal is fed into the melter-gasifier at high temperature, moisture and volatile matter are volatilized at the same time with the feeding. The reduction gas gasified in the melter-gasifier reduces the iron ore in the reduction shaft furnace, while the char (fixed carbon and ash) from which the moisture and the volatile matter are removed, descends to the lower part of the melter-gasifier to finally reduce and melt the reduced iron ore. At this time, the generated amount of the volatile matter generated by the coal is determined by the condition of the melter-gasifier such as the temperature of the furnace, the pressure of the furnace, etc. However, in the commercialized COREX process for the present, about 10% or over of coke which nearly has the volatile matter, is used based on the total amount of the fed coal for securing the heat of the furnace along with the coal of which volatile matter is about 30% under a standard condition. Since 80–90% of the coke is carbon, the calorific value per unit volume of the coke becomes larger than that of the char of the coal which contains relatively less amount of the carbon, as the coke and the char move down to the lower part of the melter-gasifier. Accordingly, the coke is advantageous in securing the furnace heat. However, the use of the more expensive coke than the coal causes an increase of the cost of fuel. Therefore, the reduction in the amount of the coke utilized is required.

Meanwhile, Alan W. Scaroni in America reported his experimental result through a journal in 1981 that the volatile matter of the coal obtained under the condition which contents the proximate analysis of ASTM, can be changed by an additive admixed with the coal under the same condition.

According to his journal, the gasification of the coal can be maximized through the increase or decrease of the amount of the volatile matter volatilized at high temperature when an oxide ($Al_2O_3$, Co—Mo—$Al_2O_3$) pellet of 1 mm size, is added to the brown coal and the soft coal of minute powder (70–100 mesh).

It is known that when aluminum oxide ($Al_2O_3$) is added, a secondary char is formed at the surface of a void present in the inner portion of the oxide to restrain the generation of the volatile matter. When Co—Mo—$Al_2O_3$ is added, the generation of the volatile matter is accelerated by the acceleration of a gasifying reaction through the catalytic reaction of cobalt (Co). When considering the above-mentioned result, the method for increasing the charring ratio of the coal by restraining the generation of the volatile matter of the coal in the COREX process, can be accomplished by feeding a new material with the coal.

However, in the COREX process, since the additional new material should not largely affect slag while giving the above-described effect, the additive should be a similar component with the slag and a small amount thereof should be added so as not to largely affect the process.

SUMMARY OF THE INVENTION

Accordingly, research and development is continued by the present inventor considering the point that the preferred additive for the charring of the coal gives the charring effect and does not specially affect the slag and the point that a small amount of the additive is preferred.

It is an object of the present invention to provide a method for increasing the charring ratio of the coal without affecting the slag an ironmaking process utilizing coal by using magnesium oxide or limestone as the additive for the charring of the coal.

To accomplish the object, there is provided in the present invention a method for increasing the charring ratio of the coal comprising the steps of mixing a magnesium oxide (Mgo) suspension or a limestone suspension with the coal which is used in the ironmaking process such as the, COREX process using the coal, and drying the mixture to attach MgO or the limestone onto the surface of the coal.

BRIEF DESCRIPTION OF THE DRAWINGS

The above object and advantages of the present invention will become more apparent by a reading of the following detailed description of the preferred embodiments thereof with reference to the attached drawings in which.

DETAILED DESCRIPTION OF THE INVENTION

Figure 1:
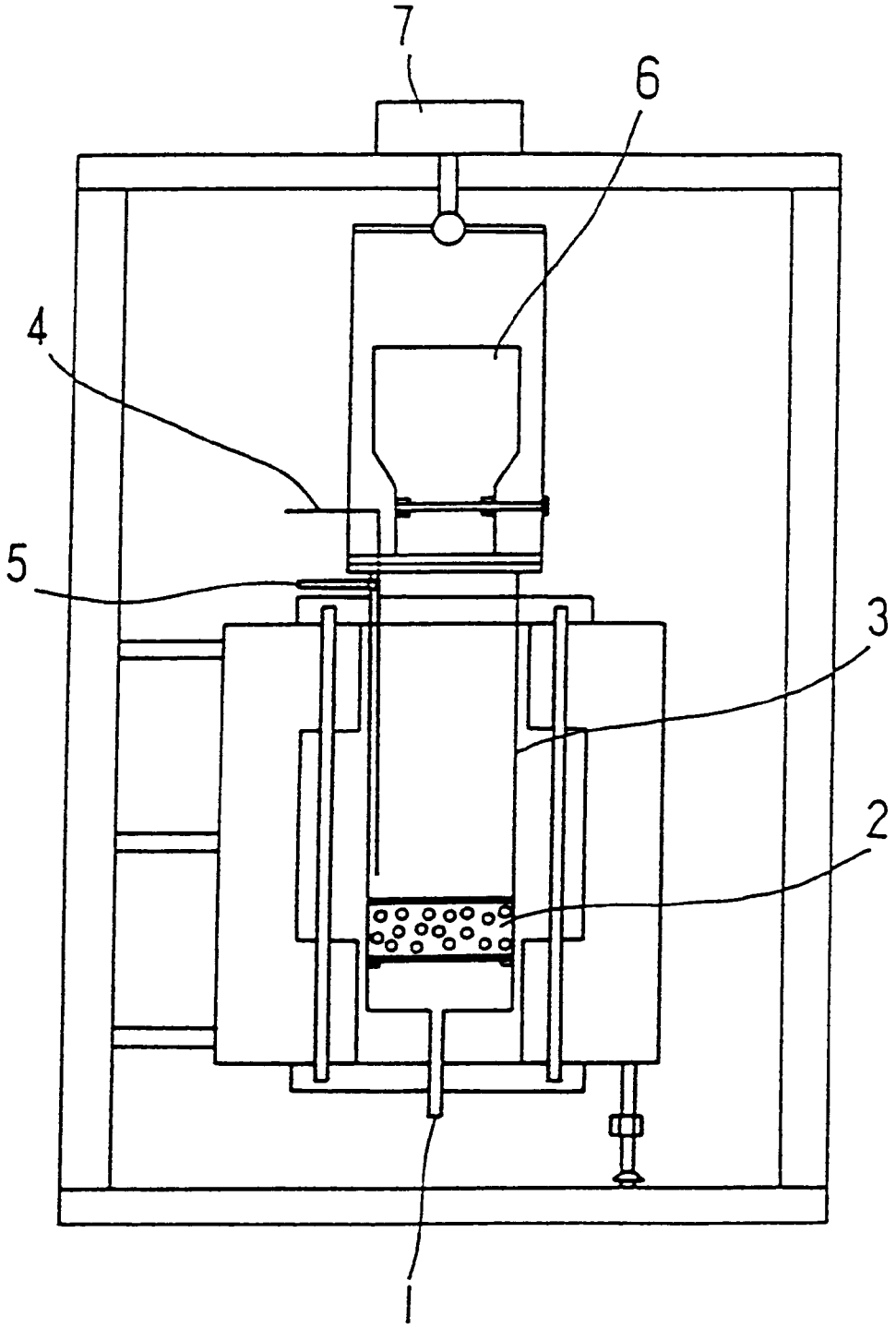
FIG. 1 is a schematic cross-sectional view of an experimental apparatus for charring coal.

Hereinafter, the method for increasing the charring of the coal according to the preferred embodiment of the present invention will be explained in more detail with reference to the accompanying drawings.

The present inventor continued the research and accomplished the present invention considering the point that the charring ratio of the coal can be increased to reduce the amount of the coke used through the restraining of the generation of the volatile matter of the coal when feeding the coal in the melter-gasifier of high temperature in a smelting reduction process such as the COREX process.

In the COREX process, the method for increasing the charring ratio by restraining the generation of the volatile matter of the coal, introduces the feeding of a new material with the coal. However, the additional material should not affect the slag while giving this effect in the COREX process. Accordingly, the component of the additive should be similar to the component of the slag and the amount of the additive should be small as far as possible to decrease the affection to the process. Considering the above-mentioned point, the limestone which is most widely used sub-material in the COREX process and magnesium oxide (MgO) which is produced from magnesium carbonate ($MgCO_3$) are selected as the additive for the charring of the coal, in the present invention.

That is, the charring ratio of the coal can be increased without affecting the slag by using the limestone or MgO as the additive for increasing the charring ratio of the coal in the present invention.

A limestone suspension or an MgO suspension is prepared for increasing the charring ratio of the coal through coating the limestone or MgO onto the surface of the coal according to the present invention. The suspensions are prepared so that the limestone and MgO are mixed homogeneously.

The preferred amount of the limestone or MgO in the prepared limestone suspension or the MgO suspension is 2–20 g based on 100 g of dried coal. If the amount of the limestone or MgO is less than 2 g based on 100 g of the dried coal, the increasing effect of the charring ratio is insufficient and if the amount of the limestone or MgO is about 20 g based on 100 g of the dried coal, the surface of the coal can be covered by sufficient amount of the limestone or MgO. Therefore, the preferred amount of the limestone or MgO to be mixed with the coal is 2–20 g based on 100 g of the dried coal.

The amount of the limestone (suspension) or MgO (suspension) mixed with respect to the coal depends on the basicity of the slag ($B4=(CaO+MgO)/(Al_2O_3+SiO_2)$) required in the ironmaking process, namely COREX the process utilizing the coal.

Accordingly, when the basicity of the slag required in the COREX ironmaking process, COREX utilizing the coal, is 1.0–1.3, the preferred amount of limestone mixed with the coal is 2.0–17 g based on 100 g of dried coal and the preferred amount of MgO mixed with the coal is 2.0–9.7 g based on 100 g of dried coal.

Generally, since the basicity of the slag required in the COREX ironmaking process, is kept at 1.12, the maximum amount of MgO added is about 9.7 g based on 100 g of the coal and the maximum amount of limestone added is about 17 g based on 100 g of coal, which are calculated considering the composition of ash when the composition of the ash is the same with that of the ash contained in the coal used in the examples described hereinafter. The amount of the total ash is 9.5%; $SiO_2$=6.517%, $Al_2O_3$=2.28%, MgO=0.057% and CaO=0.067%.

After mixing the limestone suspension or the MgO suspension with the coal and drying the mixture, the limestone or MgO is homogeneously attached or coated to the surface of the coal. At this time, the drying is implemented at 100–300° C. for about 1 minute to 3 hours. The drying process can be implemented as a separate process. However, it is preferred that the drying process is carried out along with the drying process for removing moisture before feeding the coal in the melter-gasifier.

If the limestone or MgO is homogeneously attached or coated to the surface of the coal by the method described above, the volatilization of the volatile matter of the coal, can be restrained during the charring of the coal. As the result, the charring ratio can be increased by the restrained amount from the volatilization.

The present invention will be described in detail with reference to the examples, hereinafter.

EXAMPLE 1

The experimental apparatus (experimental furnace) in FIG. 1, which was reproduced from the melter-gasifier, was used for examining the effect of the additive, MgO on the charring of the coal under the same condition.

As illustrated in FIG. 1, nitrogen gas was supplied through an inert gas inlet 1 which was provided at the lower part of the experimental furnace. The nitrogen gas passed through an alumina ball layer 2 and the temperature of the nitrogen was sufficiently increased while passing through alumina ball layer 2. Then, the nitrogen gas passed through a reaction vessel 3 and exhausted through a gas outlet 5. At this time, the amount of the supplied nitrogen gas was 150 l/min and the diameter of reaction vessel 3 was 150 mm. The temperature of the experimental furnace was set to 1000° C.

In FIG. 1, reference numeral 4 represents a thermocouple, 6 represents a hopper and 7 represents a load cell.

The particle size of the coal to be fed into the experimental furnace, was directly classified in the yard and the coal having a particle size of 8–10 mm was screened. The screened coal was divided into two equal parts and one of the parts was dried in the drier without post-treatment.

Meanwhile, an MgO suspension was prepared for homogeneous coating on the coal. The MgO suspension and the other part of the coal referred to above was mixed in a mixing ratio of MgO and coal as illustrated in Table 1, and the mixture was dried in the drier. The drying was implemented at 105° C. for 3 hours.

The coal and the coal having Mgo on the surface thereof dried in the drier, were fed in the experimental furnace. The amount of the fed coal was 200 g (8–10 mm), which made about 3 layers of the coal particles in the reaction vessel. After the feeding, the weight change during the reaction was observed using load cell 7 installed at the upper portion of the experimental furnace. The results are illustrated in Table 1 and FIG. 2.

The results on the weight change were determined after repeating the feed for three times for the purpose of reducing the analytic error. The same amount of the coal was fed when the weight change was hardly observed (8–10 mm; 3 minutes).

The charring of the coal was examined by measuring the weight reducing progress during the reaction and the final weight of the coal through the above-mentioned experiment.

Figure 2:
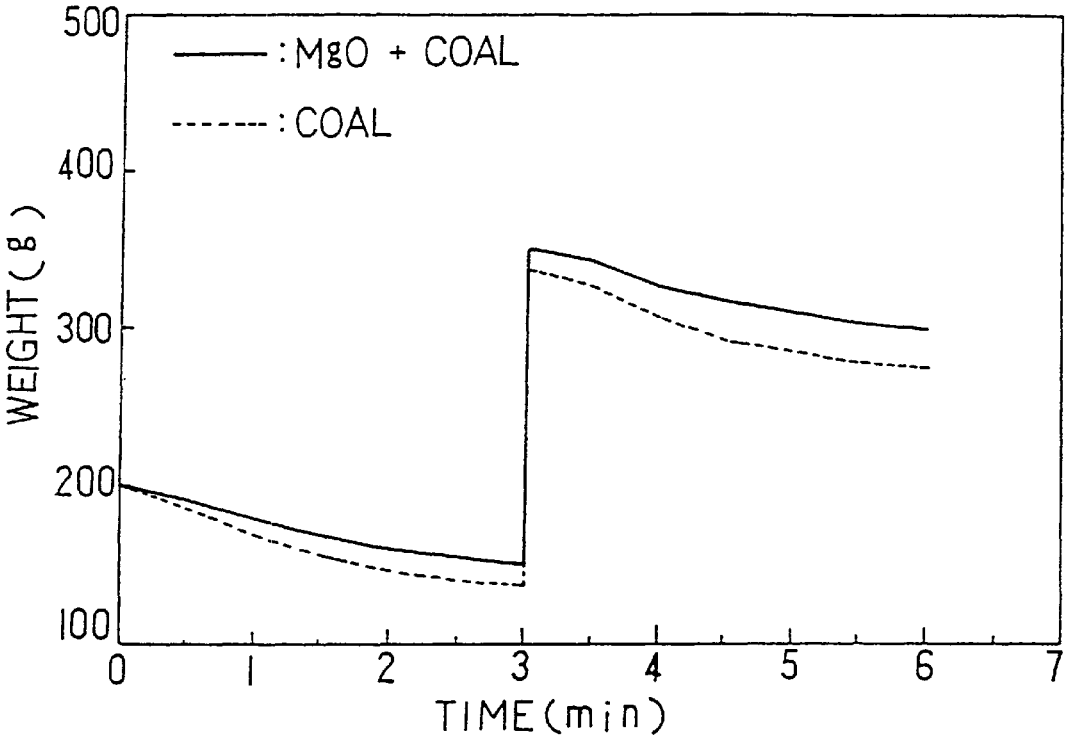
FIG. 2 is a graph for showing the weight change according to time on coal and coal having magnesium oxide attached onto the surface thereof, for observing the effect of the magnesium oxide on the charring of the coal.

As illustrated in FIG. 2, it is shown that the weight reduction amount of the coal having MgO on the surface thereof, is less than the reduction amount of the unrelated coal. This means that MgO coated on the surface of the coal restrains the volatilization of the volatile matter in the coal.

As illustrated in Table 1, when comparing the generating ratios of the volatile matter of the coal having MgO as the additive and the coal having no MgO, it can be shown that the generating ratio of the volatile matter of the coal having MgO is about 2/3 of that of the coal having no MgO. In the coal having MgO attached on the surface thereof, 22% of 387.93 g of the fed coal is volatilized as the volatile matter and the remaining coal is charred. This gives the same effect when the coal including 22% of the volatile matter is used. Otherwise, when only the coal is used, 32% of 399.92 g of the fed coal is volatilized as the volatile matter.

TABLE 1

| | coal having MgO | coal having no MgO |
|---|---|---|
| coal(g) | 387.93 | 399.92 |
| additive(g) | 12.21 | — |
| total weight(g) | 400.14 | 399.92 |

TABLE 1-continued

| | coal having MgO | coal having no MgO |
|---|---|---|
| weight after reaction(g) | 299.93 | 270.43 |
| reduction of total weight(g, %) | 100.21(22.68%) | 129.49(32.38%) |

EXAMPLE 2

The experiment was complemented according to the same condition as described in example 1, except that limestone was used as the additive to increase the charring ratio of the coal.

A limestone suspension was prepared. The limestone suspension and the other part of the coal were mixed according to the ratio illustrated in Table 2 mixture was dried in the drier in order to homogeneously attach the limestone onto the surface of the coal. The drying was carried out at 105° C. for 3 hours.

After the drying in the drier, the coal and the coal having the limestone coated on the surface thereof were fed in the experimental furnace. The amount of the fed coal was 200 g (8–10 mm), and this made about 3 layers of the coal particles in the reaction vessel. After the immersing, the weight change during the reaction was observed using load cell 7 installed at the upper portion of the experimental furnace. The results are illustrated in Table 2 and FIG. 3.

The results on the weight change were determined after repeating the feed for three times for the purpose of reducing the analytic error. The same amount of the coal was fed when the weight change was hardly observed (8–10 mm; 3 minutes).

The charring of the coal was examined by measuring the weight reducing progress during the reaction and the final weight of the coal through the above-mentioned experiment.

Figure 3:
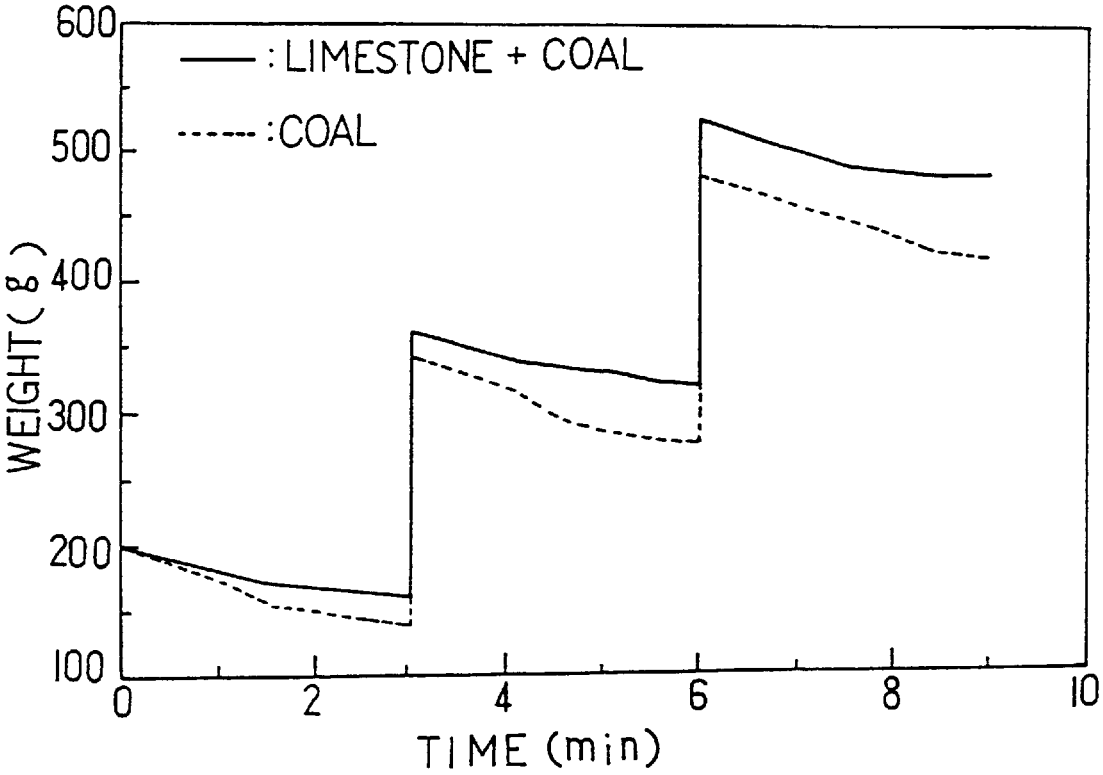
FIG. 3 is a graph showing the weight change according to time on coal and coal having limestone attached onto the surface thereof, for observing the effect of the limestone on the charring of the coal.

As illustrated in FIG. 3, it is shown that the weight reduction of the coal having the limestone coating, is less than the weight reduction amount of the coal unrelated. This means that the limestone attached onto the surface of the coal restrains the volatilization of the volatile matter.

As illustrated in Table 2, when comparing the generating ratios of the volatile matter of the coal having the limestone as the additive and the coal having no limestone, it can be shown that the generating ratio of the volatile matter of the coal having the limestone is about 2/3 of that of the coal having no limestone. In the coal having the limestone attached onto the surface thereof, 19% of 558 g of the immersed coal is volatilized as the volatile matter and the remaining coal is charred. This gives the same effect when the coal including 19% of the volatile matter is used. Otherwise, when only the coal is used, 31.89% of 600 g of the fed coal is volatilized as the volatile matter.

TABLE 2

| | coal having limestone | coal having no limestone |
|---|---|---|
| coal(g) | 558.44 | 600.38 |
| additive(g) | 40.66 | — |
| total weight(g) | 599.09 | 600.38 |

TABLE 2-continued

| | coal having limestone | coal having no limestone |
|---|---|---|
| weight after reaction(g) | 472.89 | 408.91 |
| reduction of total weight(g, %) | 126.20(21.07%) | 191.47(31.89%) |
| coal(g) | 108.35(18.09%) | 191.47 |
| additive(g) | 17.85(1.98%) | — |
| reduction of weight(g) | 19.40% | 31.89% |

As described above, the charring effect of the coal is increased by the present invention. Accordingly, the amount of the coke can be reduced by the increased amount of the charring.

Although the preferred embodiment of the invention has been described, it is understood that the present invention should not be limited to the preferred embodiment, but various changes and modifications can be made by one skilled in the art within the spirit and scope of the invention as hereinafter claimed.

What is claimed is:

1. A method for increasing a charring ratio of coal used for reducing and melting an iron ore in a melter-gasifier in the smelting reducing ironmaking process, comprising the steps of:

preparing a magnesium oxide (MgO) suspension;

mixing said prepared MgO suspension with said coal wherein said MgO suspension is mixed with said coal so that the amount of MgO in said MgO suspension is in the range from about 2 g to about 9.7 g based on 100 g of dried coal when said basicity of said slag required in said ironmaking process is about 1.0 to about 1.3;

drying said mixture to attach MgO onto a surface of said coal so as to restrain the generation of volatile matter of the thus obtained coal in the melter-gasifier; and feeding said coal into the melter-gasifier in the smelting reducing ironmaking process.

2. A method for increasing a charring ratio of coal used for reducing and melting an iron ore in a melter-gasifier in the smelting reduction ironmaking process, comprising the steps of:

preparing a limestone suspension;

mixing said prepared limestone suspension with said coal wherein said limestone suspension is mixed with said coal so that the amount of said limestone in said limestone suspension is in the range from about 2 g to about 17.0 g based on 100 g of dried coal when said basicity of said slag required in said ironmaking process is about 1.0 to about 1.3;

drying said mixture to attach said limestone onto a surface of said coal so as to restrain the generation of the volatile matter of the thus obtained coal in the melter-gasifier; and feeding said coal into the melter-gasifier in the smelting reducing ironmaking process.

* * * * *

UNITED STATES PATENT AND TRADEMARK OFFICE

CERTIFICATE OF CORRECTION

PATENT NO. : 6,203,848 B1
DATED : March 20, 2001
INVENTOR(S) : Min Young Cho et al.

It is certified that error appears in the above-identified patent and that said Letters Patent is hereby corrected as shown below:

Column 1,
Line 26, before "amount" delete "generated".

Column 2,
Line 15, "slag an ironmaking" should read -- slag in an ironmaking --.
Line 21, "(Mgo)" should read -- (MgO) --.
Lines 35 and 39, "coal and coal" should read -- coal and on coal --.

Column 3,
Line 17, delete "increasing effect of the" and insert -- increased --.
Line 31, after "process," delete "COREX utilizing the coal,".

Column 4,
Line 27, "Mgo" should read -- MgO --.
Line 45, after "reduction" delete "amount".
Line 46, "unrelated" should read -- untreated --.

Column 5,
Line 26, delete "and this" and insert -- which --.
Line 42, "coal unrelated." should read -- untreated coal. --.

Signed and Sealed this

Fifteenth Day of January, 2002

*Attest:*

*Attesting Officer*

JAMES E. ROGAN
*Director of the United States Patent and Trademark Office*